US006126523A

United States Patent [19]

Moriyasu et al.

[11] Patent Number: 6,126,523

[45] Date of Patent: Oct. 3, 2000

[54] OPTICAL DRESSING METHOD, MACHINING DEVICE BASED ON THIS METHOD, GRINDSTONE AND POLISHING CLOTH

[75] Inventors: Sei Moriyasu, Tokyo; Hitoshi Ohmori; Takeo Nakagawa, both of Wako; Kazuyuki Horie, Tokyo; Shinjirou Machida, Tokyo; Takashi Yamashita, Tokyo, all of Japan

[73] Assignee: The Institute of Physical and Chemical Research, Saitama, Japan

[21] Appl. No.: 09/297,820

[22] PCT Filed: Aug. 19, 1998

[86] PCT No.: PCT/JP98/03662

§ 371 Date: Aug. 9, 1999

§ 102(e) Date: Aug. 9, 1999

[87] PCT Pub. No.: WO99/12705

PCT Pub. Date: Mar. 18, 1999

[30] Foreign Application Priority Data

Sep. 8, 1997 [JP] Japan ..... 9-242815

[51] Int. Cl.[7] ..... B24B 1/00

[52] U.S. Cl. ..... 451/56; 125/2; 125/3; 451/443

[58] Field of Search ..... 451/5, 6, 28, 41, 451/56, 285, 443, 444; 125/2, 3, 11.01

[56] References Cited

FOREIGN PATENT DOCUMENTS 61-152367 7/1986 Japan .
9-285962 11/1997 Japan .

*Primary Examiner*—Derris H. Banks
*Attorney, Agent, or Firm*—Griffin & Szipl, P.C.

[57] ABSTRACT

A photo-reactive grinding wheel 1 is irradiated with light by a light irradiation device 2 which is provided opposite to the grinding wheel, to bring about a chemical reaction and change in property, and dissolved/removed by a solution 4. Simultaneously, a workpiece 5 is processed by the photo-reactive grinding wheel 1. Thus, processing can be performed without causing clogging in the grinding wheel of a resin bond containing fine abrasive grains, high-grade surface roughness can be realized, and processing efficiency is relatively high. The controllability of the dressing is excellent, automation of dressing and in-process dressing can also be realized, a system which contains no metal ion in the whole processing can be designed, an expensive device is not required, and handling is easy.

13 Claims, 6 Drawing Sheets

OPTICAL DRESSING METHOD, MACHINING DEVICE BASED ON THIS METHOD, GRINDSTONE AND POLISHING CLOTH

BACKGROUND OF THE INVENTION

1. Technical Field of the Invention

The present invention relates to method and device in which a grinding wheel and an abrasive cloth are dressed using light.

2. Description of the Related Art

With the development of recent scientific technique, high accuracy is required also for processing technique. In the field of abrasive machining as well, the processing accuracy and the repeatability of processing become more important than ever. For example, polishing work is an indispensable technique as a CMP technique in the semiconductor manufacture process. As an important technique in the abrasive machining, a dressing technique as a means for stable processing while preventing a tool from being clogged can be exemplified. For the dressing technique, many means such as mechanical/electrical means, means using a laser, and the like have been proposed and are properly used according to the kind of a tool to be used or the like.

The mechanical dressing means uses a single dresser, a rotary dresser, or the like to mechanically remove a tool surface and perform dressing, and is used for many tools.

As electrical means, there are means for electrolyzing an electrically-conductive tool to melt a tool surface, means for discharging electricity to crush a tool surface by the energy, and the like. The electrical means is effective dressing means for a rigid tool such as a metal bond grinding wheel, which is difficult to be dressed, by the mechanical means.

The means using a laser is means for converging light energy by a high-output laser, irradiating a tool surface, converting the energy into thermal energy, and melting and removing the tool surface. It can be said that this dressing means can be applied to various tools.

Recently, besides these means, means for injecting a slurry, means using free abrasive grains, means for melting a bond material by a solvent, and the like have been developed and studied.

With respect to a resin bond grinding wheel, since the bond material is softer and has higher impact absorption than other metal bond grinding wheels, a soft workpiece is not easily damaged, and high-grade surface roughness can be realized. In the resin-bond grinding wheel containing fine abrasive grains, however, clogging easily occurs. When clogging occurs, the high-grade surface roughness cannot be realized.

Although a grinding wheel with a low degree of bond has been developed in order to prevent the clogging, there are problems such that the processing efficiency is low and it is necessary to design a grinding wheel with an optimum bond degree which does not cause breaking or clogging in accordance with the material of a workpiece.

The mechanical dressing method, the means for injecting slurry, the means using free abrasive grains, the means for melting the bond material by a solvent, and the like are difficult to be carried out when the controllability and automation of the dressing and in-process dressing are considered.

Since the metal bond grinding wheel is mainly used in the electrical dressing method, a soft material is easily damaged in the processing, and it is difficult to realize high-grade surface roughness. Moreover, since a bond material of metal is dissolved as a metal ion in the dressing operation, the method is not suited for processing of an electronic part, which is easily affected by a metal ion.

According to the dressing method using a laser, since a high-output laser is used, an expensive device is necessary. The maintenance cost is high, and handling is troublesome.

SUMMARY OF THE INVENTION

The present invention has been developed in order to solve the above-mentioned problems. Specifically, an object of the present invention is to provide a photo-dressing method, a processing device using the method, a grinding wheel, and an abrasive cloth in which processing can be performed without causing clogging in a resin-bond grinding wheel containing fine abrasive grains, high-grade surface roughness can be realized, processing efficiency is relatively high, it is unnecessary to design a grinding wheel of an optimum bond degree without causing breaking or clogging in accordance with the material of a workpiece, the controllability of dressing is excellent, automation of dressing and in-process dressing can also be performed, a system containing no metal ion in the whole processing can be designed, an expensive device is not required, and handling is easy.

According to the present invention, there is provided a photo-dressing method characterized in that a light irradiation device is provided opposite to a photo-reactive grinding wheel, and the grinding wheel is irradiated with light, thereby bringing about a chemical reaction to remove the surface of the grinding wheel.

According to a preferred embodiment of the present invention, the photo-reactive grinding wheel is irradiated with light to bring about a photochemical reaction, and contains a substance whose property changes before and after light irradiation. The surface of the grinding wheel is either decomposition-removed or dissolution-removed by using a specific solution in accordance with the property of the substance contained in the photo-reactive grinding wheel.

By using the photo-dressing method of the present invention, a dressing method can be realized in which processing can be performed without causing clogging in a resin-bond grinding wheel containing fine abrasive grains, high-grade surface roughness can be realized, processing efficiency is relatively high, it is unnecessary to design a grinding wheel of an optimum bond degree without causing breaking or clogging in accordance with the material of a workpiece, the controllability of dressing is excellent, automation of dressing and in-process dressing can also be performed, a system containing no metal ion in the whole processing can be designed, an expensive device is not required, and handling is easy.

Moreover, the photo-reactive grinding wheel contains fine abrasive grains in the above description, but it may contain relatively large abrasive grains such as pillar-shaped diamonds or may not contain abrasive grains like an abrasive cloth.

Furthermore, according to the present invention, there is provided a photo-dressing processing device comprising a photo-reactive grinding wheel and a light irradiation device provided opposite to the grinding wheel, in which the grinding wheel is irradiated with light to bring about a chemical reaction and the surface of the grinding wheel is removed. It is preferable to perform the chemical reaction continuously or intermittently during processing.

With the construction, the above-mentioned photo-dressing method can effectively be carried out.

Moreover, according to the present invention, there is provided a photo-reactive grinding wheel which is irradiated with light to bring about a photochemical reaction and which contains a photo-reactive material whose property changes before and after light irradiation, and abrasive grains. By using the photo-reactive grinding wheel, since the property of the photo-reactive material is changed by light irradiation, processing can be performed without causing clogging in the grinding wheel containing fine abrasive grains.

Furthermore, according to the present invention, there is provided a photo-reactive abrasive cloth which is irradiated with light to bring about a photochemical reaction and which contains a photo-reactive material whose property changes before and after light irradiation. By using the photo-reactive abrasive cloth, since the property of the photo-reactive material is changed by light irradiation, processing can be performed without causing clogging in the abrasive cloth containing free abrasive grains.

According to a preferred embodiment of the present invention, the photo-reactive material is a positive type photo resist, which can be dissolved/removed after ultraviolet rays are radiated. By using the photo-reactive material, the photo-reactive material can be dissolved/removed using an abrasive liquid or the like after ultraviolet rays are radiated, and photo-dressing can effectively be performed.

Moreover, the photo-reactive material is preferably a resin material whose chemical structure or high-order structure is changed to become brittle after ultraviolet rays are radiated. By using the photo-reactive material, after ultraviolet rays are radiated, the surface of the grinding wheel or the abrasive cloth can be removed by a frictional force at the time of processing without using weak-alkaline aqueous solution or the like, so that photo-dressing can effectively be performed.

Moreover, the photo-reactive material may be benzoyl peroxide which is photochemically decomposed by light irradiation. By using this material, benzoyl peroxide can be photochemically decomposed only by light irradiation and efficiently removed, so that photo-dressing can effectively be performed.

The other objects and advantageous features of the present invention will become apparent from the following description with reference to the attached drawings.

DESCRIPTION OF THE PREFERRED EMBODIMENTS

Preferred embodiments of the present invention will be described hereinbelow with reference to the drawings.

Figure 1A:
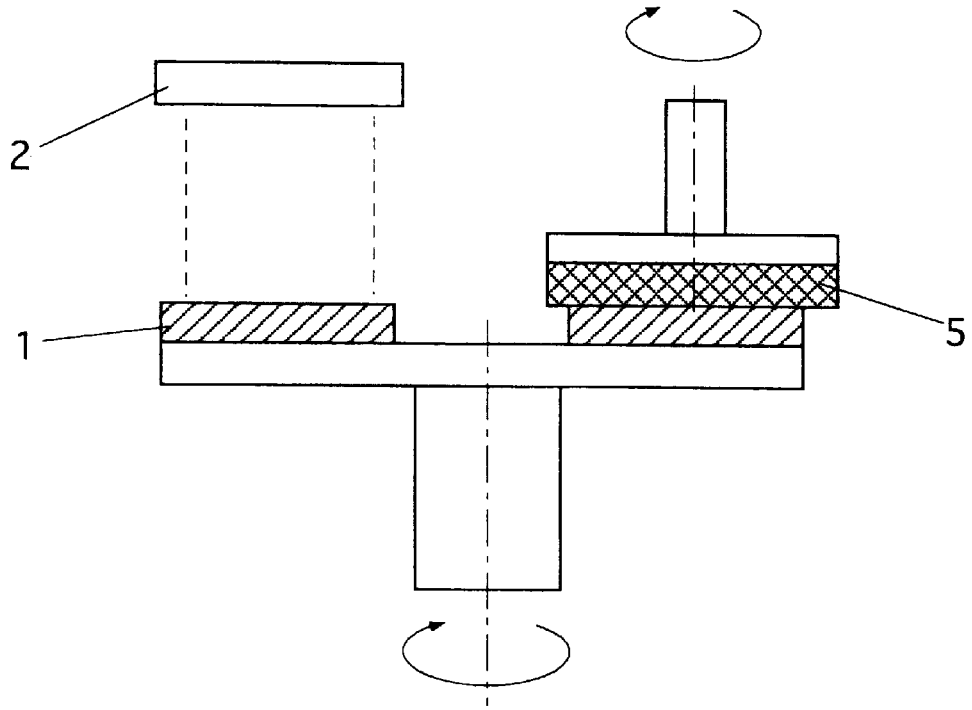
FIG. 1(A) is a schematic front view of a photo-dressing processing device according to the present invention.
Figure 1B:
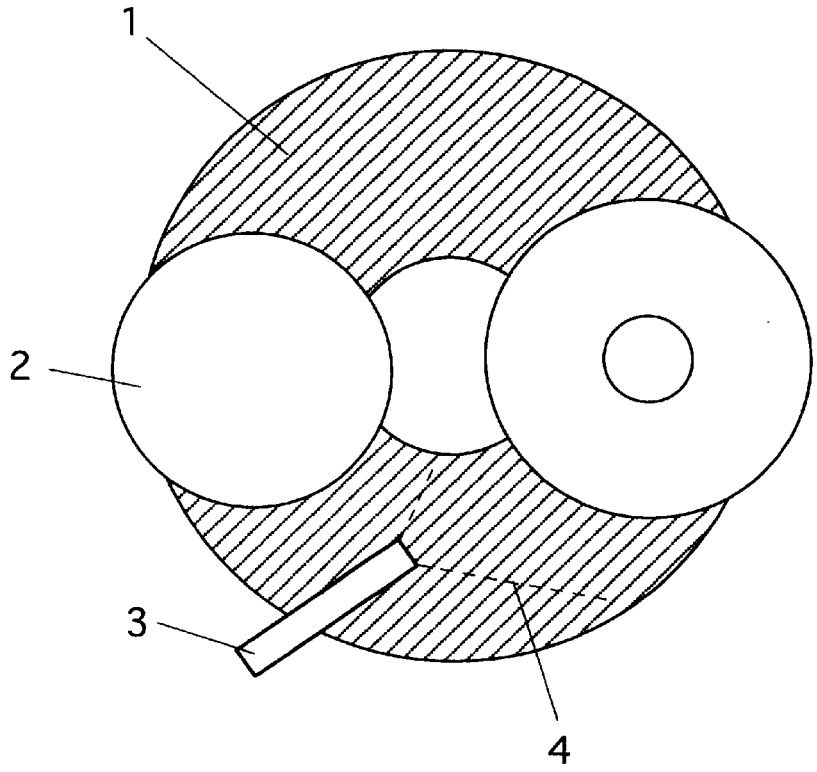
FIG. 1(B) is a schematic top view of the photo-dressing processing device according to the present invention.

FIG. 1(A) is a schematic front view of a photo-dressing processing device according to the present invention, and FIG. 1(B) is a schematic top view of the device. As shown in the drawings, the photo-dressing processing device of the present invention is provided with a photo-reactive grinding wheel 1 and a light irradiation device 2 provided opposite to the grinding wheel 1. The grinding wheel 1 is irradiated with light to bring about a chemical reaction, and the surface of the grinding wheel is removed. The chemical reaction is performed continuously or intermittently during the processing. With the construction, the photo-reactive grinding wheel 1 is irradiated with light by the light irradiation device 2, its property is changed by the chemical reaction, and the surface is dissolved/removed by a solution 4. Simultaneously, a workpiece 5 is processed by the photo-reactive grinding wheel 1.

Figure 2:
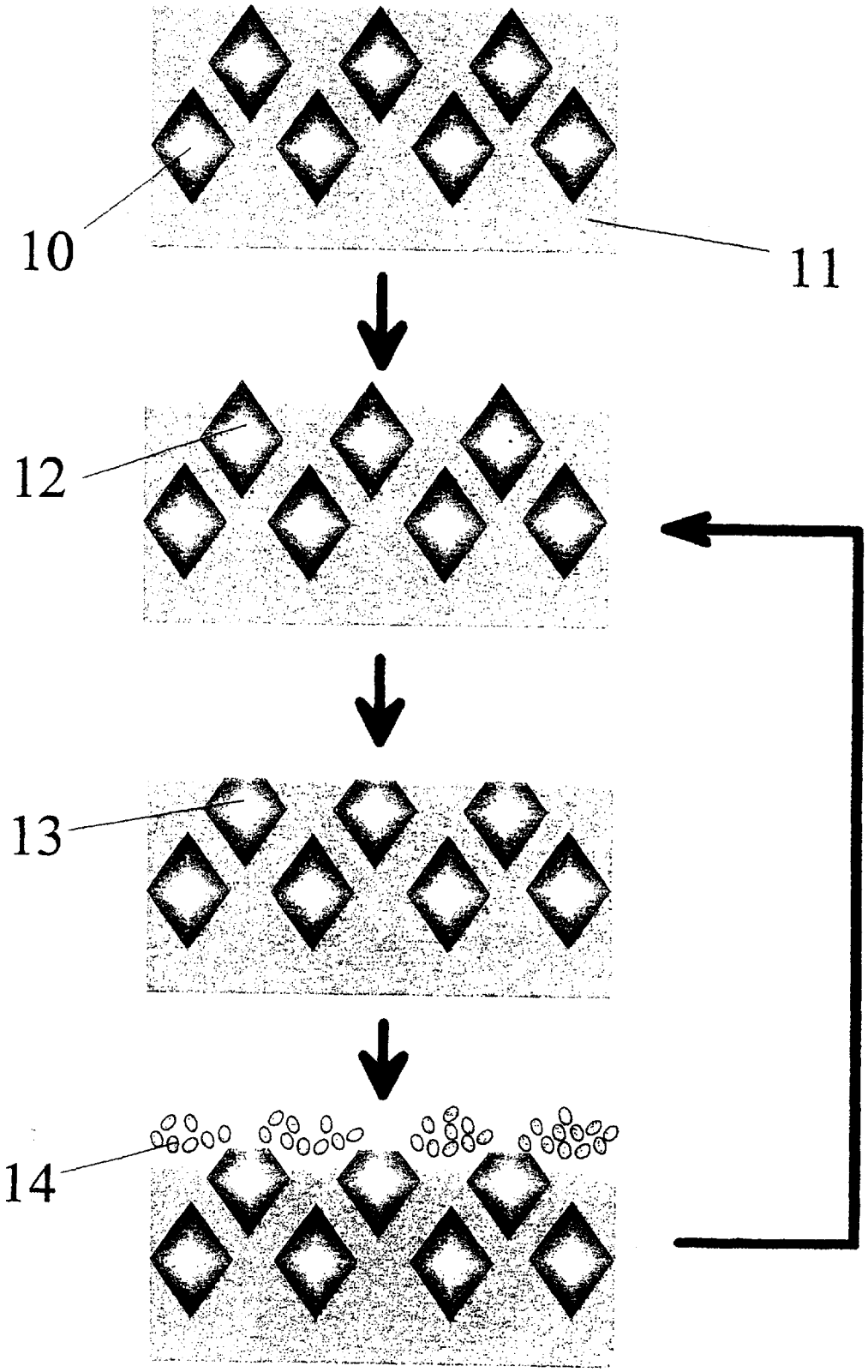
FIG. 2 is a diagram showing the principle of a photo-dressing method according to the present invention.

FIG. 2 is a diagram showing the principle of the photo-dressing method of the present invention. As shown in the diagram, the chemical reaction is brought about by irradiating the surface of the photo-reactive grinding wheel 1 with light to remove the surface of the grinding wheel, so that abrasive grains 10 are protruded from a bond material 11, and processing can be preferably performed. When the tips of the abrasive grains are worn away by the processing, the bond material is removed by light irradiation, so that the abrasive grains can be protruded again from the bond material. By maintaining this state, preferable processing without causing clogging can be maintained.

Figure 3:
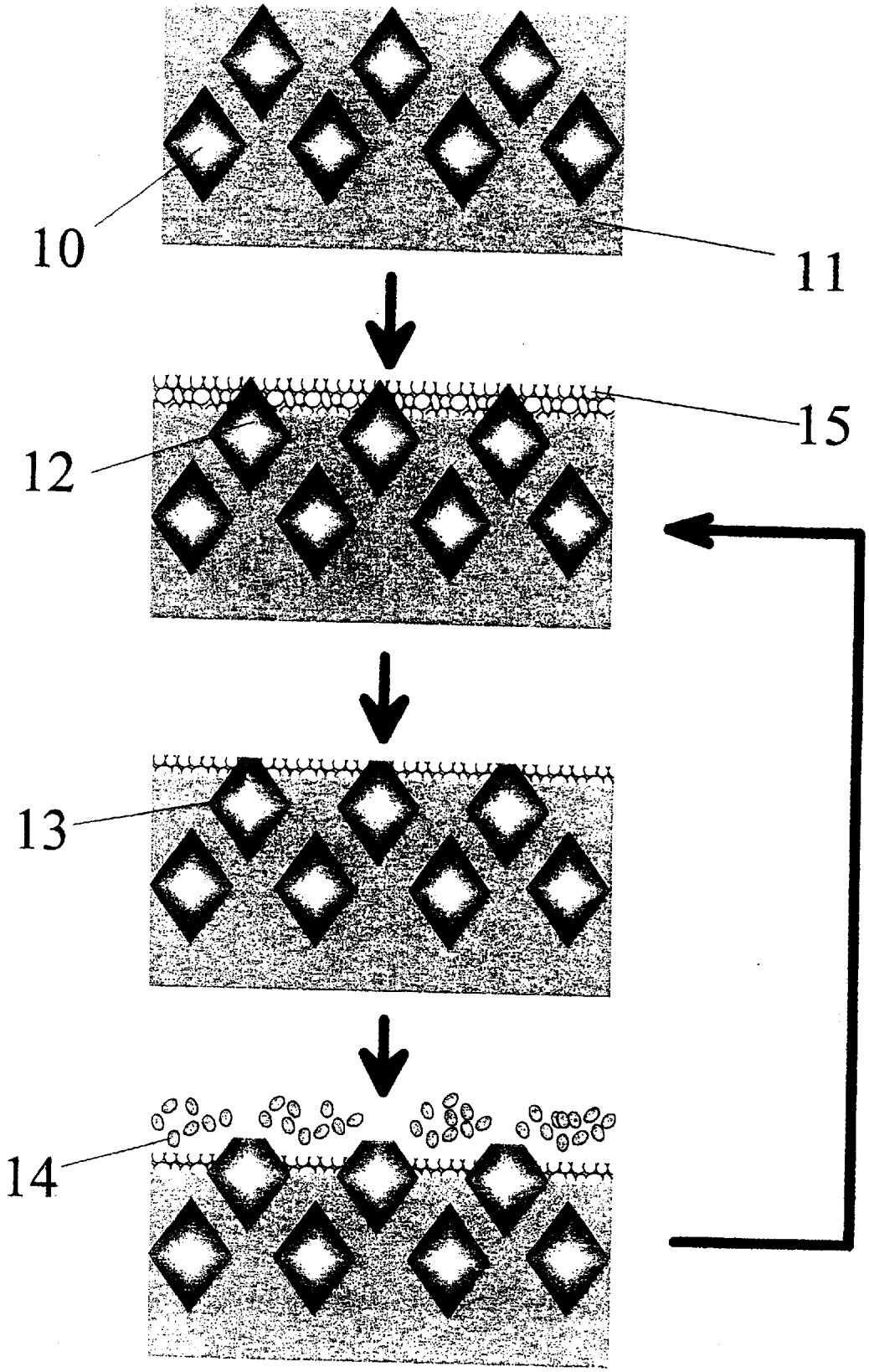
FIG. 3 is another diagram showing the principle of the method of the present invention.

FIG. 3 is another diagram showing the principle of the method of the present invention. As shown in the diagram, the bond material 11 of the photo-reactive grinding wheel 1 is made by materials of two or more kinds. The bond material 11 is partially removed by light irradiation and a thin coat 15 is formed on the surface of the grinding wheel, thereby enhancing the holding power of the abrasive grains and increasing the impact absorption of the bond material. Furthermore, heat generated in the processing can be efficiently escaped.

The photo-reactive grinding wheel 1 shown in FIGS. 1 to 3 brings about a photochemical reaction by light irradiation, and contains a photo-reactive material whose property changes before and after light irradiation and abrasive grains. When the photo-reactive material itself does not function as the bond material, it additionally contains the bond material for holding the photo-reactive material and the abrasive grains. By using the photo-reactive grinding wheel 1, since the property of the photo-reactive material is changed by light irradiation, processing can be performed without causing clogging in the grinding wheel containing fine abrasive grains.

Moreover, instead of the photo-reactive grinding wheel 1, a photo-reactive abrasive cloth may be used together with free abrasive grains. In this case, the photo-reactive abrasive cloth is irradiated with light to bring about a photochemical reaction, and contains a photo-reactive material whose property changes before and after light irradiation. By using the photo-reactive abrasive cloth, since the property of the photo-reactive material is changed by light irradiation, processing can be performed without causing clogging even in the abrasive cloth containing free abrasive grains.

For the photo-reactive material contained in the photo-reactive grinding wheel 1 or the photo-reactive abrasive cloth, for example, a positive type photo resist can be used which can be dissolved/removed after ultraviolet rays are radiated. By using the photo-reactive material, the photo-reactive material can be dissolved/removed using an abrasive liquid or the like after ultraviolet rays are radiated, and photo-dressing can effectively be performed.

Moreover, the photo-reactive material is preferably a resin material whose chemical structure or high-order structure is changed to become brittle after ultraviolet rays are radiated. As the resin material, for example, a positive type photo resist is used. By using the photo-reactive material, after ultraviolet rays are radiated, the surface of the grinding wheel or the abrasive cloth can be removed by a frictional force at the time of processing without using weak-alkaline aqueous solution or the like, so that photo-dressing can effectively be performed.

Moreover, as the photo-reactive material, benzoyl peroxide may be used which is photochemically decomposed by light irradiation. Since benzoyl peroxide generates carbon dioxide gas by photochemical decomposition, by using benzoyl peroxide as the photo-reactive material, carbon dioxide gas is generated to partially produce cracks and remove the surface of the grinding wheel or the abrasive cloth.

Hereinafter, specific examples of the present invention will be described.

Manufacture of Photo-reactive Grinding Wheel

There are various photo-reactive materials, and they are reacted in various manners, but in the present invention, a positive type photo resist generally used in a photolithography process was used. Moreover, since the positive type photo resist is generally weak to high temperatures, the grinding wheel was molded using the polymerization reaction of epoxy resin without adding heat.

Figure 4:
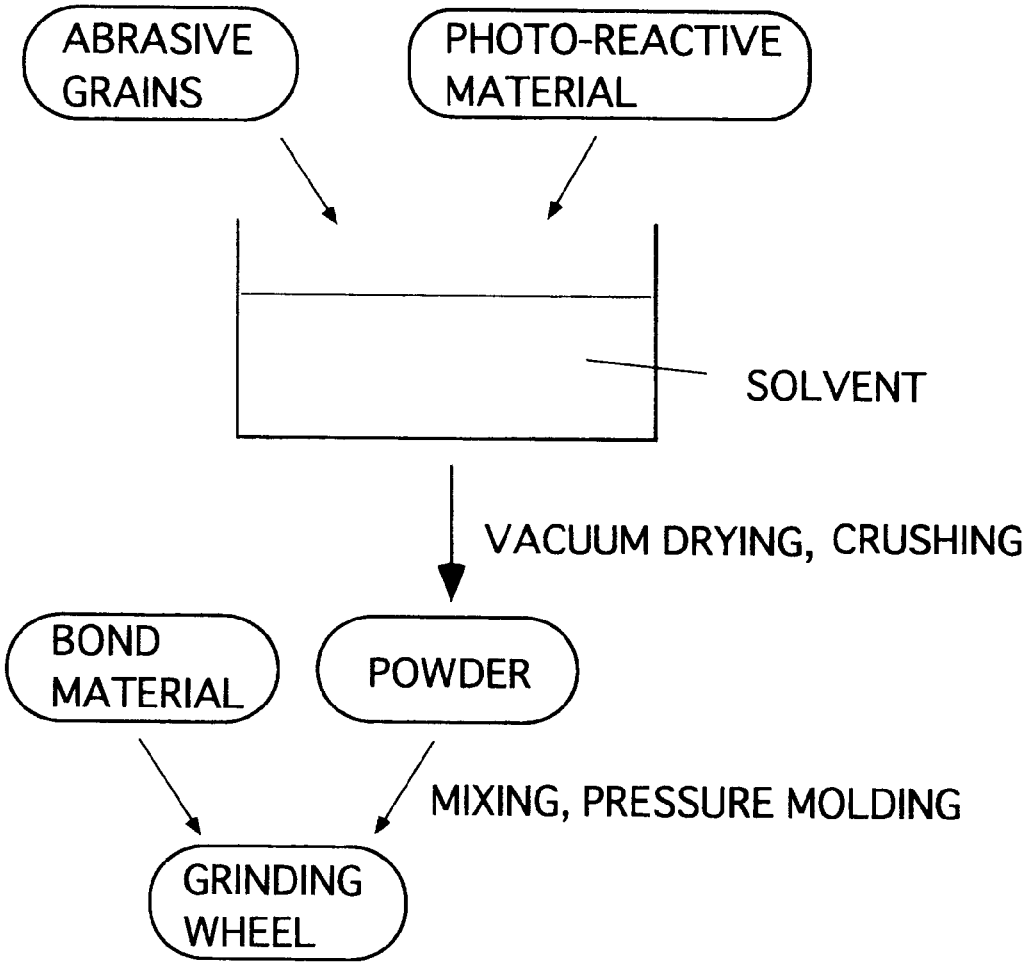
FIG. 4 is a diagram showing manufacture processes of a photo-reactive grinding wheel.

FIG. 4 shows a manufacture procedure of the photo-reactive grinding wheel. First, (1) the abrasive grains and the photo-reactive material were mixed in a solvent, and when they were uniformly mixed, vacuum drying was performed, and solvent components were removed; (2) dried powder was sufficiently ground, to obtain powder composed of the abrasive grains and the photo-reactive material; and (3) the powder was mixed with the bond material, and the mixed powder was placed in a mold for pressure molding and allowed to stand for an appropriate time, so that the bond material was solidified to complete the grinding wheel. In the example, powder (average particle diameter of about 20 $\mu$m) of white alundum (alumina) was used as the abrasive grains, while epoxy resin was used as the bond material. Additionally, when the abrasive grains and the photo-reactive material were mixed, ethyl cellosolve acetate was used as the solvent.

Additionally, when the photo-reactive material itself functions as the bond material, processes (1) and (2) are unnecessary. By directly mixing the abrasive grains and the bond material (photo-reactive material), the photo-reactive grinding wheel can be manufactured. Moreover, when benzoyl peroxide performing photochemical decomposition is used as the photo-reactive material, process (1) can be omitted because benzoyl peroxide is solid at normal temperatures.

Lap Grinding Test by Photo-reactive Grinding Wheel

A lap grinding test was conducted using the photo-reactive grinding wheel manufactured in the above-mentioned procedure. In the test, the photo-dressing processing device shown in FIG. 1 was used.

In the device of FIG. 1, the photo-reactive grinding wheel 1 is mounted on a lower face, while the workpiece 5 is pressed at a constant pressure onto a top surface, so that processing can be performed. Moreover, the light irradiation device 2 is disposed opposite to the grinding wheel 1, and the grinding wheel can be dressed by irradiating the surface of the grinding wheel with light. Around a processed point, grinding liquid (coolant) is passed to prevent a processed point temperature from rising. The grinding liquid is weak alkaline, and has a function of dissolving/removing the positive type photo resist contained in the grinding wheel 1 after ultraviolet rays are radiated. After the grinding wheel 1 was mounted on the device, a #325 cup-shaped cobalt-bond diamond grinding wheel was mounted on the top surface of the grinding wheel 1 instead of the workpiece. After tooling of the photo-reactive grinding wheel 1, the photo-dressing processing was performed according to the present invention while light was radiated. In the photo-dressing processing, the grinding-wheel rotational speed, the workpiece rotational speed, and the applied pressure were 100 rpm, 80 rpm, and 2.9 kgf/cm$^2$, respectively.

Figure 5A:
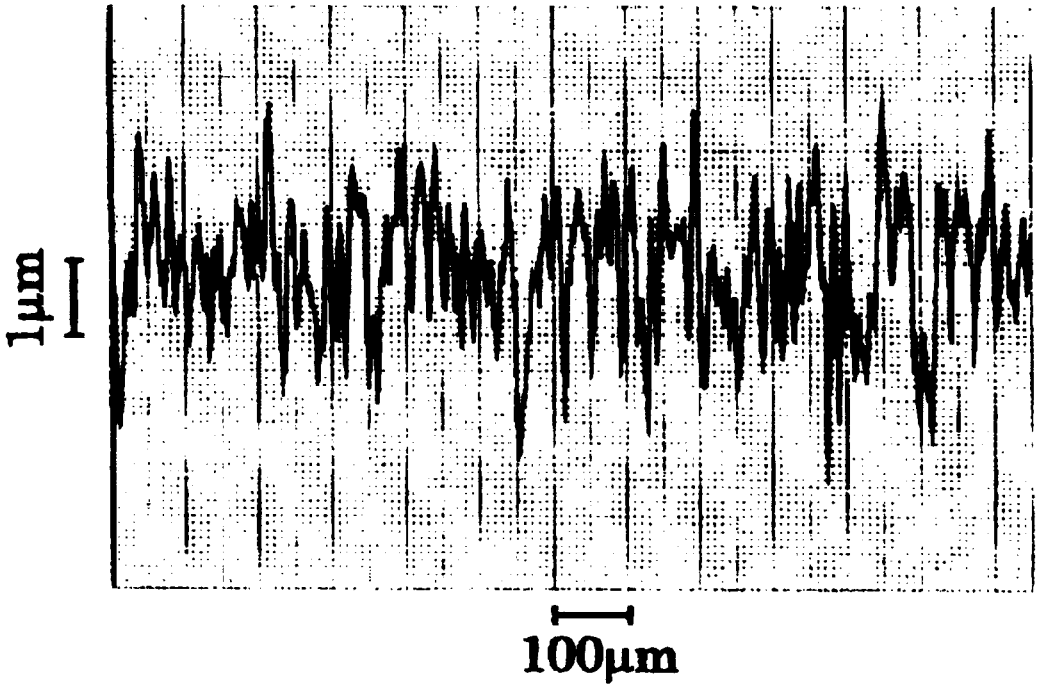
FIG. 5(A) is a diagram showing the surface roughness of a workpiece before processing.
Figure 5B:
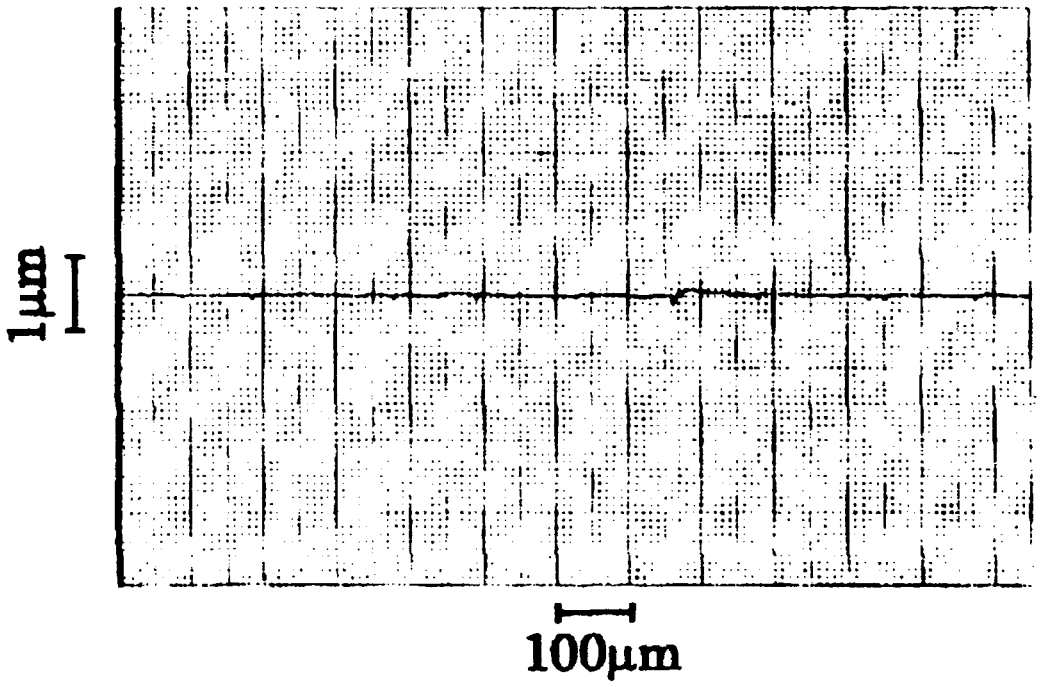
FIG. 5(B) is a diagram showing the surface roughness of the workpiece after processing.

FIGS. 5(A) and 5(B) show the surface roughness of the workpiece before and after processing, respectively. It is seen from the drawings that the surface roughness is largely enhanced by the photo-dressing processing of the present invention.

Figure 6:
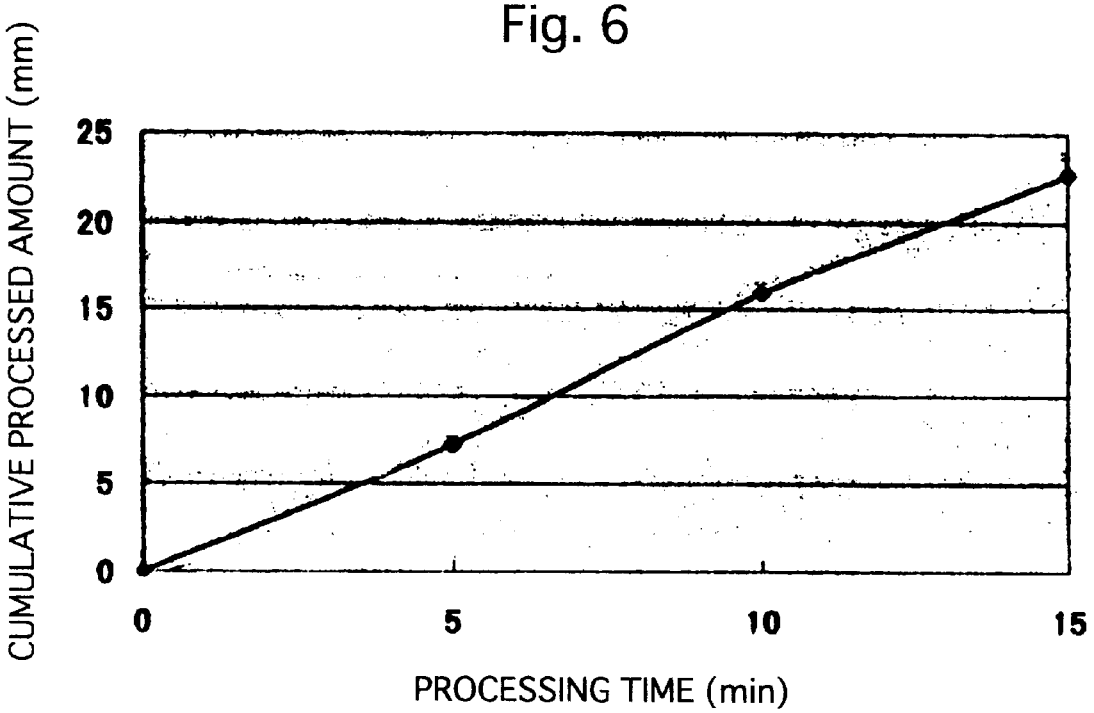
FIG. 6 is a graph showing a relationship of processing time and a cumulative processed amount.

Moreover, FIG. 6 is a graph showing the thickness of the workpiece measured every five minutes. The cumulative processed amount is increased substantially straight relative to time, which indicates that the sharpness of the grinding wheel is kept constant by the photo-dressing.

Figure 7:
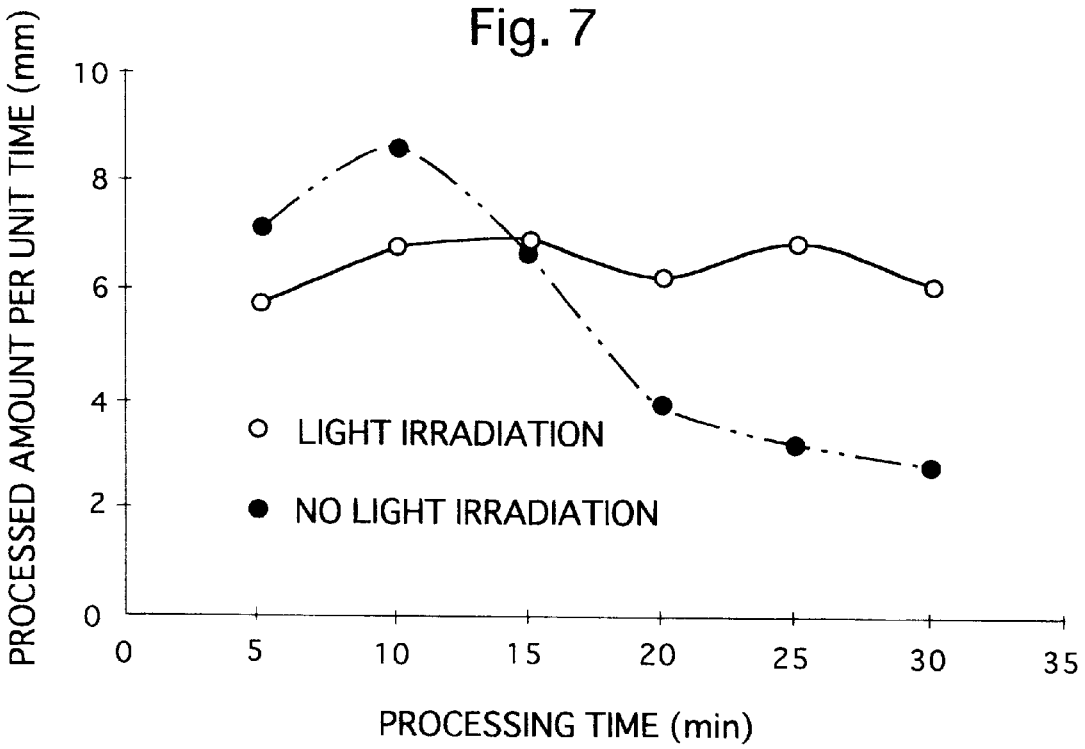
FIG. 7 is a graph showing comparison of a processed amount per unit time depending on the presence of ultraviolet rays.

Furthermore, FIG. 7 is a comparison diagram of the processed amount per unit time depending on the presence of ultraviolet rays. In the drawing, white circles represent the case ultraviolet rays are radiated, while black circles represent the case no ultraviolet rays are radiated. It is seen from the drawings that when no ultraviolet rays are radiated, the processed amount per unit time is remarkably lowered by clogging, but when ultraviolet rays are radiated, the processed amount becomes substantially constant.

As mentioned above, the photo-dressing method of the present invention, the processing device by the method, the grinding wheel and the abrasive cloth have excellent effects such that processing can be performed without causing clogging in the resin-bond grinding wheel containing fine abrasive grains, high-grade surface roughness can be realized, processing efficiency is relatively high, it is unnecessary to design a grinding wheel having an optimum bond degree and causing neither breaking nor clogging in accordance with the material of the workpiece, the controllability of dressing is excellent, automation of dressing and in-process dressing can also be realized, a system containing no metal ion in the whole processing can be designed, an expensive device is not required, and handling is easy.

Although the present invention has been described by some preferable embodiments, it will be understood that the scope of rights included in the present invention is not limited by the embodiments. On the contrary, the scope of rights of the present invention includes all of improvements, modifications, and equivalents included in the scope of the appended claims.

What is claimed is:

1. A photo-dressing method which comprises the steps of providing a light irradiation device opposite to a photo-reactive grinding wheel and irradiating the grinding wheel with light to bring about a chemical reaction, so that a surface of the grinding wheel is removed.

2. The photo-dressing method according to claim 1, wherein said photo-reactive grinding wheel is irradiated with light to bring about a photochemical reaction, and contains a substance whose property changes before and after light irradiation.

3. The photo-dressing method according to claim 1, wherein the surface of said grinding wheel is either decomposition-removed or dissolution-removed by using a specific solution in accordance with a property of a substance contained in the photo-reactive grinding wheel.

4. A photo-dressing processing device which comprises a photo-reactive grinding wheel and a light irradiation device provided opposite to said grinding wheel, the grinding wheel being irradiated with light to bring about a chemical reaction, so that a surface of the grinding wheel is removed.

5. The photo-dressing processing device according to claim 4, wherein said chemical reaction is continuously or intermittently performed during processing.

6. A photo-reactive grinding wheel which is irradiated with light to bring about a photochemical reaction and which contains a photo-reactive material whose property changes before and after light irradiation, and abrasive grains.

7. The photo-reactive grinding wheel according to claim 6, wherein said photo-reactive material is a positive type photo resist which can be dissolved and removed after ultraviolet rays are radiated.

8. The photo-reactive grinding wheel according to claim 6, wherein said photo-reactive material is a resin material whose chemical structure or high-order structure is changed to become brittle after ultraviolet rays are radiated.

9. The photo-reactive grinding wheel according to claim 6, wherein said photo-reactive material is benzoyl peroxide which is photochemically decomposed by light irradiation.

10. A photo-reactive abrasive cloth which is irradiated with light to bring about a photochemical reaction and which contains a photo-reactive material whose property changes before and after light irradiation.

11. The photo-reactive abrasive cloth according to claim 10, wherein said photo-reactive material is a positive type photo resist which can be dissolved and removed after ultraviolet rays are radiated.

12. The photo-reactive abrasive cloth according to claim 10, wherein said photo-reactive material is a resin material whose chemical structure or high-order structure is changed to become brittle after ultraviolet rays are radiated.

13. The photo-reactive abrasive cloth according to claim 10, wherein said photo-reactive material is benzoyl peroxide which is photochemically decomposed by light irradiation.

* * * * *